US008685210B2

(12) United States Patent
Gaston et al.

(10) Patent No.: US 8,685,210 B2
(45) **Date of Patent: *Apr. 1, 2014**

(54) BITUMINOUS FROTH INLINE STEAM INJECTION PROCESSING

(75) Inventors: Les Gaston, Fort McMurray (CA); Donald Norman Madge, Calgary (CA); William Lester Strand, Edmonton (CA); Ian Noble, Fort McMurray (CA); William Nicholas Garner, Fort McMurray (CA); Mike Lam, Fort McMurray (CA)

(73) Assignee: Suncor Energy Inc., Fort McMurray, Alberta (CA)

( * ) Notice: Subject to any disclaimer, the term of this patent is extended or adjusted under 35 U.S.C. 154(b) by 376 days.

This patent is subject to a terminal disclaimer.

(21) Appl. No.: 13/073,939

(22) Filed: Mar. 28, 2011

(65) Prior Publication Data

US 2011/0174592 A1 Jul. 21, 2011

Related U.S. Application Data

(60) Continuation of application No. 12/493,910, filed on Jun. 29, 2009, now Pat. No. 7,914,670, which is a division of application No. 10/825,230, filed on Apr. 16, 2004, now Pat. No. 7,556,715.

(30) Foreign Application Priority Data

Jan. 9, 2004 (CA) ..... 2455011

(51) Int. Cl.
*B01D 11/00* (2006.01)

(52) U.S. Cl.
USPC ..... 196/14.52; 208/390; 96/176

(58) Field of Classification Search
USPC ..... 208/390; 196/14.52; 210/532.1; 95/262; 96/176
See application file for complete search history.

(56) References Cited

U.S. PATENT DOCUMENTS 685,895 A 11/1901 Wirth
1,590,156 A 6/1926 Ellis (Continued)

FOREIGN PATENT DOCUMENTS

CA 280272 5/1928
CA 630710 11/1961

(Continued)

OTHER PUBLICATIONS

Alberta Oil History, An Interview with Roger Butler, vol. 2 Issue 2, pp. 33-35.

(Continued)

*Primary Examiner* — Nina Bhat
(74) *Attorney, Agent, or Firm* — Knobbe, Martens, Olson & Bear, LLP

(57) ABSTRACT

An inline bitumen froth steam heater system including steam injection and static mixing devices is provided. The system heats and de-aerates input bitumen froth without creating downstream processing problems with the bitumen froth such as emulsification or live steam entrainment. The system is a multistage unit that injects and thoroughly mixes steam with bitumen resulting in output bitumen material having temperature of about 190° F. The system conditions a superheated steam supply to obtain saturated steam at about 300° F. The saturated steam is contacted with bitumen froth flow and mixed in a static mixer stage. The static mixers provide surface area and rotating action that allows the injected steam to condense and transfer its heat to the bitumen froth. The mixing action and increase in temperature of the bitumen froth results in reduction in bitumen viscosity and allows the release of entrapped air from the bitumen froth.

26 Claims, 2 Drawing Sheets

(56) References Cited

U.S. PATENT DOCUMENTS 1,598,973 A 9/1926 Kolsky
2,052,881 A 9/1936 Klipstein et al.
2,236,796 A 4/1941 Kipper
2,734,019 A 2/1956 Miller et al.
2,847,353 A 8/1958 Beavon
2,910,424 A 10/1959 Tek et al.
2,921,023 A 1/1960 Holm
3,159,562 A 12/1964 Bichard et al.
3,509,641 A 5/1970 Smith et al.
3,594,201 A 7/1971 Sommer et al.
3,607,104 A * 9/1971 Blickle et al. ..... 422/141
3,617,530 A 11/1971 Rieve et al.
3,798,157 A 3/1974 Manzanilla et al.
3,807,090 A 4/1974 Moss
3,808,120 A 4/1974 Smith
3,876,532 A 4/1975 Plundo et al.
3,893,907 A 7/1975 Canevari
3,967,777 A 7/1976 Canevari
3,971,718 A 7/1976 Reid
3,998,702 A * 12/1976 Opoku ..... 196/14.52
4,033,853 A 7/1977 Hann
4,035,282 A 7/1977 Stuchberry et al.
4,072,609 A 2/1978 Kizior
4,101,333 A 7/1978 Wayment
4,116,809 A * 9/1978 Kizior ..... 208/425
4,120,776 A 10/1978 Miller et al.
4,172,025 A 10/1979 Porteous et al.
4,279,743 A 7/1981 Miller
4,305,733 A 12/1981 Scholz et al.
4,337,143 A 6/1982 Hanson et al.
4,383,914 A 5/1983 Kizior
4,397,741 A 8/1983 Miller
4,399,027 A 8/1983 Miller
4,399,112 A 8/1983 Voirin
4,409,090 A 10/1983 Hanson et al.
4,410,417 A 10/1983 Miller et al.
4,424,113 A 1/1984 Mitchel
4,437,998 A 3/1984 Yong
4,462,892 A 7/1984 Schramm et al.
4,470,899 A 9/1984 Miller et al.
4,486,294 A 12/1984 Miller et al.
4,502,950 A 3/1985 Ikematsu et al.
4,514,287 A 4/1985 Ikematsu et al.
4,514,305 A 4/1985 Filby
4,525,155 A 6/1985 Nilsson
4,525,269 A 6/1985 Ikematsu et al.
4,528,100 A 7/1985 Zarchy
4,532,024 A 7/1985 Haschke et al.
4,545,892 A 10/1985 Cymbalisty et al.
4,581,142 A 4/1986 Fladby et al.
4,585,180 A 4/1986 Potts
4,604,988 A 8/1986 Rao
4,634,519 A 1/1987 Danzik
4,677,074 A 6/1987 Holden
4,733,828 A 3/1988 Potts
4,744,890 A 5/1988 Miller et al.
4,781,331 A 11/1988 Potts
4,783,268 A 11/1988 Leung
4,799,627 A 1/1989 Potts
4,828,393 A 5/1989 Smals et al.
4,838,434 A 6/1989 Miller et al.
4,851,123 A 7/1989 Mishra
4,859,317 A 8/1989 Shelfantook et al.
4,915,819 A 4/1990 Chirinos et al.
4,981,579 A 1/1991 Paspek et al.
4,994,097 A 2/1991 Brouwers
5,009,773 A 4/1991 Schramm et al.
5,017,281 A 5/1991 Sadeghi et al.
5,032,275 A 7/1991 Thew
5,039,398 A 8/1991 Stine et al.
5,055,202 A 10/1991 Carroll et al.
5,073,177 A 12/1991 Brouwers
5,092,983 A 3/1992 Eppig et al.
5,118,408 A 6/1992 Jansen et al.
5,124,008 A 6/1992 Rendall et al.
5,143,598 A 9/1992 Graham et al.
5,156,751 A 10/1992 Miller
5,186,820 A 2/1993 Schultz et al.
5,207,805 A 5/1993 Kalen et al.
5,223,148 A 6/1993 Tipman et al.
5,236,577 A 8/1993 Tipman et al.
5,242,580 A 9/1993 Sury
5,242,604 A 9/1993 Young et al.
5,264,118 A 11/1993 Cymerman et al.
5,295,350 A 3/1994 Child et al.
5,316,664 A 5/1994 Gregoli et al.
5,340,467 A 8/1994 Gregoli et al.
5,480,566 A 1/1996 Strand
5,538,539 A 7/1996 Spokoyny et al.
5,540,755 A 7/1996 Spokoyny et al.
5,581,864 A 12/1996 Rabet
5,626,191 A 5/1997 Greaves et al.
5,645,714 A 7/1997 Strand et al.
5,667,543 A 9/1997 Brouwers
5,723,042 A 3/1998 Strand et al.
5,740,834 A 4/1998 Sherowski
5,798,087 A 8/1998 Suda et al.
5,820,750 A 10/1998 Blum et al.
5,876,592 A 3/1999 Tipman et al.
5,897,769 A 4/1999 Trachte et al.
5,910,242 A 6/1999 Halbert et al.
5,928,501 A 7/1999 Sudhakar et al.
5,961,821 A 10/1999 Varadaraj et al.
5,968,349 A 10/1999 Duyvesteyn et al.
5,985,137 A 11/1999 Ohsol et al.
5,985,138 A 11/1999 Humphreys
6,007,709 A 12/1999 Duyvesteyn et al.
6,033,187 A 3/2000 Addie
6,063,266 A 5/2000 Grande et al.
6,086,751 A 7/2000 Bienstock et al.
6,096,196 A 8/2000 Varadaraj et al.
6,119,870 A 9/2000 Maciejewski et al.
6,123,835 A 9/2000 Ackerson et al.
6,132,630 A 10/2000 Briant et al.
6,149,887 A 11/2000 Lagas et al.
6,162,350 A 12/2000 Soled et al.
6,183,341 B1 2/2001 Melcer
6,214,213 B1 4/2001 Tipman et al.
6,281,328 B1 8/2001 Sartori et al.
6,319,099 B1 11/2001 Tanoue et al.
6,358,404 B1 * 3/2002 Brown et al. ..... 208/390
6,391,190 B1 * 5/2002 Spence et al. ..... 208/390
6,398,973 B1 6/2002 Saunders et al.
6,412,557 B1 7/2002 Ayasse et al.
6,428,686 B1 8/2002 Ackerson et al.
6,464,859 B1 10/2002 Duncum et al.
6,521,079 B1 2/2003 Roy
6,531,055 B1 3/2003 Greaney
6,585,560 B2 7/2003 Tanoue et al.
6,596,170 B2 7/2003 Tuszko et al.
6,640,548 B2 11/2003 Brushwood et al.
6,702,877 B1 3/2004 Swanborn
6,768,115 B2 7/2004 Mikula et al.
6,800,116 B2 * 10/2004 Stevens et al. ..... 95/262
6,818,058 B2 11/2004 Ronin
6,907,831 B1 6/2005 Rising
6,991,037 B2 1/2006 Hocking
7,013,937 B2 3/2006 Potts
7,056,487 B2 6/2006 Newby
7,141,162 B2 11/2006 Garner et al.
7,556,715 B2 * 7/2009 Gaston et al. ..... 196/14.52
7,914,670 B2 * 3/2011 Gaston et al. ..... 208/390
8,225,944 B2 * 7/2012 Bjornson et al. ..... 210/532.1
2001/0005986 A1 7/2001 Matsubara et al.
2001/0042713 A1 11/2001 Conrad et al.
2002/0148755 A1 10/2002 Ackerson et al.
2002/0148777 A1 10/2002 Tuszko
2003/0000214 A1 1/2003 Grewe et al.
2003/0029775 A1 2/2003 Cymerman et al.
2003/0056517 A1 3/2003 Brushwood et al.
2003/0070963 A1 4/2003 Zimmermann et al.
2003/0168391 A1 9/2003 Tveiten
2003/0205507 A1 11/2003 Mikula et al.
2004/0011057 A1 1/2004 Huber

(56) References Cited

U.S. PATENT DOCUMENTS

| | | | |
|---|---|---|---|
| 2004/0055972 | A1 | 3/2004 | Garner et al. |
| 2004/0069705 | A1 | 4/2004 | Tuszko et al. |
| 2004/0094456 | A1 | 5/2004 | Dries |
| 2004/0164001 | A1 | 8/2004 | Rhodey |
| 2004/0172951 | A1 | 9/2004 | Hannemann et al. |
| 2004/0182754 | A1 | 9/2004 | Lange |
| 2004/0247509 | A1 | 12/2004 | Newby |
| 2004/0251731 | A1 | 12/2004 | Potts |
| 2005/0051500 | A1 | 3/2005 | Price et al. |
| 2005/0126455 | A1 | 6/2005 | Rising |
| 2005/0172818 | A1 | 8/2005 | Hunt et al. |
| 2005/0173726 | A1 | 8/2005 | Potts |
| 2005/0226094 | A1 | 10/2005 | Damhuis |
| 2006/0091249 | A1 | 5/2006 | Potts |
| 2006/0138036 | A1 | 6/2006 | Garner et al. |
| 2006/0138055 | A1 | 6/2006 | Garner et al. |
| 2006/0248872 | A1 | 11/2006 | Bachovchin et al. |
| 2007/0006526 | A1 | 1/2007 | Cullen |

FOREIGN PATENT DOCUMENTS

| | | |
|---|---|---|
| CA | 680576 | 2/1964 |
| CA | 694547 | 9/1964 |
| CA | 741303 | 8/1966 |
| CA | 841581 | 5/1970 |
| CA | 857306 | 12/1970 |
| CA | 873854 | 6/1971 |
| CA | 882667 | 10/1971 |
| CA | 889825 | 1/1972 |
| CA | 910271 | 9/1972 |
| CA | 952844 | 8/1974 |
| CA | 970308 | 7/1975 |
| CA | 1026252 | 2/1978 |
| CA | 1027853 | 3/1978 |
| CA | 1029322 | 4/1978 |
| CA | 1041451 | 10/1978 |
| CA | 1044628 | 12/1978 |
| CA | 1055868 | 5/1979 |
| CA | 1059052 | 7/1979 |
| CA | 1066644 | 11/1979 |
| CA | 1072473 | 2/1980 |
| CA | 1072474 | 2/1980 |
| CA | 1080357 | 6/1980 |
| CA | 1081641 | 7/1980 |
| CA | 1094003 | 1/1981 |
| CA | 1097574 | 3/1981 |
| CA | 1126187 | 6/1982 |
| CA | 1137906 | 12/1982 |
| CA | 1138822 | 4/1983 |
| CA | 1144098 | 4/1983 |
| CA | 1153347 | 9/1983 |
| CA | 1231692 | 1/1984 |
| CA | 1163257 | 3/1984 |
| CA | 1164383 | 3/1984 |
| CA | 1180426 | 1/1985 |
| CA | 1194622 | 1/1985 |
| CA | 1193586 | 9/1985 |
| CA | 1182463 | 12/1985 |
| CA | 1201412 | 3/1986 |
| CA | 1210167 | 8/1986 |
| CA | 1214421 | 11/1986 |
| CA | 1232854 | 2/1988 |
| CA | 1236065 | 5/1988 |
| CA | 1251772 | 3/1989 |
| CA | 1254171 | 5/1989 |
| CA | 1266250 | 2/1990 |
| CA | 1266261 | 2/1990 |
| CA | 1266844 | 3/1990 |
| CA | 1267860 | 4/1990 |
| CA | 1270220 | 6/1990 |
| CA | 1272153 | 7/1990 |
| CA | 1275063 | 10/1990 |
| CA | 1288375 | 9/1991 |
| CA | 2037856 | 9/1991 |
| CA | 1293465 | 12/1991 |
| CA | 2022300 | 1/1992 |
| CA | 1301692 | 5/1992 |
| CA | 2054620 | 5/1992 |
| CA | 1303702 | 6/1992 |
| CA | 1304314 | 6/1992 |
| CA | 1305390 | 7/1992 |
| CA | 2058221 | 7/1992 |
| CA | 1313550 | 2/1993 |
| CA | 1313845 | 2/1993 |
| CA | 1317277 | 5/1993 |
| CA | 1318273 | 5/1993 |
| CA | 1318876 | 6/1993 |
| CA | 2088179 | 8/1993 |
| CA | 1323173 | 10/1993 |
| CA | 1325180 | 12/1993 |
| CA | 2108521 | 4/1994 |
| CA | 1329277 | 5/1994 |
| CA | 2086073 | 6/1994 |
| CA | 2000984 | 11/1994 |
| CA | 2106900 | 3/1995 |
| CA | 2049793 | 6/1995 |
| CA | 1337410 | 10/1995 |
| CA | 2133911 | 4/1996 |
| CA | 2029795 | 11/1996 |
| CA | 2178189 | 12/1996 |
| CA | 2180686 | 2/1997 |
| CA | 2229342 | 3/1997 |
| CA | 2015979 | 10/1997 |
| CA | 2088203 | 10/1997 |
| CA | 2263691 | 3/1998 |
| CA | 2021185 | 9/1998 |
| CA | 2029756 | 9/1998 |
| CA | 2200899 | 9/1998 |
| CA | 2232929 | 9/1998 |
| CA | 2208767 | 12/1998 |
| CA | 2294860 | 12/1998 |
| CA | 2088227 | 2/1999 |
| CA | 2242394 | 2/1999 |
| CA | 2249679 | 4/1999 |
| CA | 2250623 | 4/1999 |
| CA | 2220821 | 5/1999 |
| CA | 2308410 | 5/1999 |
| CA | 2255071 | 6/1999 |
| CA | 2227520 | 9/1999 |
| CA | 2266570 | 9/1999 |
| CA | 2236183 | 10/1999 |
| CA | 2273123 | 12/1999 |
| CA | 2184613 | 1/2000 |
| CA | 2345271 | 4/2000 |
| CA | 2231321 | 6/2000 |
| CA | 2176639 | 8/2000 |
| CA | 2365008 | 8/2000 |
| CA | 2140380 | 9/2000 |
| CA | 2198623 | 10/2000 |
| CA | 2182453 | 12/2000 |
| CA | 2304938 | 2/2001 |
| CA | 2397612 | 7/2001 |
| CA | 2254048 | 9/2001 |
| CA | 2358805 | 10/2001 |
| CA | 2246841 | 11/2001 |
| CA | 2311738 | 11/2001 |
| CA | 2409129 | 11/2001 |
| CA | 2315596 | 2/2002 |
| CA | 2332207 | 2/2002 |
| CA | 2217300 | 8/2002 |
| CA | 2227667 | 11/2002 |
| CA | 2350001 | 12/2002 |
| CA | 2353109 | 1/2003 |
| CA | 2454278 | 1/2003 |
| CA | 2259037 | 4/2003 |
| CA | 2569689 | 4/2003 |
| CA | 2398026 | 6/2003 |
| CA | 2498862 | 7/2003 |
| CA | 2419325 | 8/2003 |
| CA | 2518040 | 9/2003 |
| CA | 2448680 | 2/2004 |
| CA | 2400258 | 3/2004 |
| CA | 2471048 | 3/2004 |

(56) References Cited

FOREIGN PATENT DOCUMENTS

| | | | |
|---|---|---|---|
| CA | 2522514 | | 11/2004 |
| CA | 2435113 | | 1/2005 |
| CA | 2307819 | | 4/2005 |
| CA | 2548370 | | 5/2005 |
| CA | 2548371 | | 5/2005 |
| CA | 2453697 | | 6/2005 |
| CA | 2493677 | | 6/2005 |
| CA | 2549895 | | 6/2005 |
| CA | 2455623 | | 7/2005 |
| CA | 2558059 | | 8/2005 |
| CA | 2243957 | | 9/2005 |
| CA | 2562974 | | 10/2005 |
| CA | 2509308 | | 12/2005 |
| CA | 2509309 | | 12/2005 |
| CA | 2538464 | | 2/2006 |
| CA | 2521335 | | 3/2006 |
| CA | 2248129 | | 4/2006 |
| CN | 1112033 | | 11/1995 |
| CN | 2263552 | Y | 10/1997 |
| CN | 2263552 | Y | 10/1997 |
| CN | 2520942 | Y | 11/2002 |
| CN | 2520942 | Y | 11/2002 |
| CN | 1701856 | | 11/2005 |
| DE | 2153098 | | 4/1972 |
| EP | 262916 | | 6/1988 |
| EP | 355127 | | 6/1989 |
| EP | 286160 | | 5/1990 |
| EP | 493858 | B1 | 7/1992 |
| EP | 332641 | | 3/1994 |
| EP | 605746 | | 7/1994 |
| EP | 1028811 | | 8/2000 |
| EP | 1234914 | | 8/2002 |
| EP | 1586546 | A2 | 10/2005 |
| EP | 1600215 | | 11/2005 |
| EP | 1501636 | | 8/2006 |
| GB | 17954 | | 5/1913 |
| GB | 169063 | | 9/1921 |
| GB | 195055 | | 1/1924 |
| GB | 539383 | | 9/1941 |
| GB | 552880 | | 4/1943 |
| GB | 591347 | | 8/1947 |
| GB | 603082 | | 9/1948 |
| GB | 634135 | | 3/1950 |
| GB | 665472 | | 1/1952 |
| GB | 723149 | | 2/1955 |
| GB | 726841 | | 3/1955 |
| GB | 723489 | | 9/1955 |
| GB | 767605 | | 2/1957 |
| GB | 767944 | | 2/1957 |
| GB | 768107 | | 2/1957 |
| GB | 773121 | | 4/1957 |
| GB | 789228 | | 1/1958 |
| GB | 807713 | | 1/1959 |
| GB | 808104 | | 1/1959 |
| GB | 814610 | | 6/1959 |
| GB | 815155 | | 6/1959 |
| GB | 957048 | | 5/1964 |
| GB | 1253701 | | 11/1971 |
| GB | 1302064 | | 1/1973 |
| GB | 1428174 | | 3/1976 |
| GB | 1510053 | | 5/1978 |
| GB | 1510054 | | 5/1978 |
| GB | 1527940 | | 10/1978 |
| GB | 2047735 | | 1/1980 |
| GB | 2075543 | | 11/1981 |
| GB | 2116447 | | 9/1983 |
| JP | 53142396 | | 12/1985 |
| JP | 61082856 | | 4/1986 |
| JP | 5096492 | | 4/1993 |
| JP | 5208815 | | 8/1993 |
| JP | 7237921 | | 9/1995 |
| WO | WO 83/00318 | | 2/1983 |
| WO | WO 83/02071 | | 6/1983 |
| WO | WO 83/03062 | | 9/1983 |
| WO | WO 83/03444 | | 10/1983 |
| WO | WO 86/00302 | | 1/1986 |
| WO | WO 86/07396 | | 12/1986 |
| WO | WO 93/25751 | | 12/1993 |
| WO | WO 94/11444 | | 5/1994 |
| WO | WO 94/19091 | | 9/1994 |
| WO | WO 94/23823 | | 10/1994 |
| WO | WO 95/07750 | | 3/1995 |
| WO | WO 96/06899 | | 3/1996 |
| WO | WO 96/29149 | | 9/1996 |
| WO | WO 98/58739 | | 12/1998 |
| WO | WO 99/36174 | | 7/1999 |
| WO | WO 99/54049 | | 10/1999 |
| WO | WO 00/10896 | | 3/2000 |
| WO | WO 00/29507 | | 5/2000 |
| WO | WO 00/35585 | | 6/2000 |
| WO | WO 00/74815 | | 12/2000 |
| WO | WO 01/53660 | | 7/2001 |
| WO | WO 01/85611 | | 11/2001 |
| WO | WO 02/074881 | | 9/2002 |
| WO | WO 02/092231 | | 11/2002 |
| WO | WO 03/006165 | | 1/2003 |
| WO | WO 03/008768 | | 1/2003 |
| WO | WO 03/045544 | | 6/2003 |
| WO | WO 03/047730 | | 6/2003 |
| WO | WO 03/056134 | | 7/2003 |
| WO | WO 03/074394 | | 9/2003 |
| WO | WO 03/082455 | | 10/2003 |
| WO | WO 03/092901 | | 11/2003 |
| WO | WO 2004/005673 | | 1/2004 |
| WO | WO 2004/094061 | | 11/2004 |
| WO | WO 2005/000454 | | 1/2005 |
| WO | WO 2005/046874 | | 5/2005 |
| WO | WO 2005/046875 | | 5/2005 |
| WO | WO 2005/069804 | | 8/2005 |
| WO | WO 2005/070821 | | 8/2005 |
| WO | WO 2005/072877 | | 8/2005 |
| WO | WO 2005/080878 | | 9/2005 |
| WO | WO 2005/092479 | | 10/2005 |
| WO | WO 2005/092788 | | 10/2005 |
| WO | WO 2005/123226 | | 12/2005 |
| WO | WO 2006/034339 | | 3/2006 |
| WO | WO 2006/035209 | | 4/2006 |
| WO | WO 2006/037045 | | 4/2006 |
| WO | WO 2006/040269 | | 4/2006 |
| WO | WO 2006/065459 | | 6/2006 |
| WO | WO 2006/085759 | | 8/2006 |
| WO | WO 2006/121503 | | 11/2006 |
| WO | WO 2006/132527 | | 12/2006 |
| WO | WO 2007/001174 | | 1/2007 |
| WO | WO 2007/021181 | | 2/2007 |

OTHER PUBLICATIONS

Al-Shamali and Greaves, "In Situ Combustion (ISC) Processes: Enhances Oil Recovery Using Horizontal Wells", School of Chemical Engineering, University of Bath, UK, Trans IChemE, vol. 71, Part A, May 1993, pp. 345-346.

Bagci et al., A Comparison of Dry Forward Combusion with Diverse Well Configurations in a 3-D Physical Model Using Medium and Low Gravity Crudes, Middle East Technical University, Pages (10 pages).

Bratsch et al., On the Existence of Na in Liquid Ammonia, American Chemical Society, 1984, pp. 1086-1089.

Collison, Hot About Thai: A Calgary company researches a step-change in bitumen recovery technology, Oilweek, Mar. 1, 2004, pp. 42-46.

District 5 CIM Conference, Presentation slides "Identification and Treatment of Weathered Ores at Suncor's Steepbank Mine" Jun. 14, 2001, Alberta, Canada, Jones and Goldstein "The SkyMine Process", Skyonic Corporation Sep. 20, 2005.

European Commission, European Symposium on Heavy Oil Technologies in a Wider Europe, A Therme Programme Action Berlin, Jun. 7 & 8, 1994, Greaves, Wang and Al-Shamali, "Insitu Combustion (ISC) Processes: 3D Studies of Vertical and Horizontal Wells", IOR Research Group, School of Chemical Engineering, University of Bath, UK.

(56) References Cited

OTHER PUBLICATIONS

Eva Mondt, Compact Centrifugal Separator of Dispersed Phases, Proefschrift.
Fenske et al., Extraction of Petroleum Fractions by Ammonia Solvents, E.I.Ch.E. Journal, vol. 1, Issue 3, pp. 335-341.
Greaves et al., Horizontal Producer Wells in in Site Combustion (ISC) Process, The Journal of Canadian Petroleum Technology, Apr. 1993, vol. 32, Issue 4, pp. 58-67.
IEO 1997 World Oil Markets "The World Oil Market" pp. 1-19.
Industry Statistics "Montly Petroleum Facts at a Glance" Jan. 2002 pp. 1-2.
Jones et al., The SkyMine Process, Skyonic Corporation, Sep. 20, 2005.
Keller et al., A Unique, Reagent-Based, Separation Method for Tar Sands and Environmentall Clean Ups, AIChE 2001 Annual Meeting, Nov. 6, 2001, Reno, Nevada.
Krebs' Engineers, Krebs D-Series gMAX DeSanders for Oil and Gas, Bulletin, vol. 11, Issue 203 WEL.
Lagowski, Liquid Ammonia—A Unique Solvent, Chemistry vol. 41, No. 4, pp. 10-15.
Lemley et al., Liquid Ammonia Solutions. X. A Raman Study of Interactions in the liquid State, The Journal of Physical Chemistry, 1973, vol. 77, Issue 18, pp. 2185-2191.
Miner's Toolbox, Mine Backfill Engineering, 2000-2005.
MINESPACE 2001, Presentation slides "Identification ad Treatment of Weathered Ores at Suncor's Steepbank Mine", May 2, 2001; Quebec City, Canada.
National Energy Board, Canada's Oil Sands: A Supply and Market Outlook to 2015, An Energy Market Assessment, Oct. 2000.
Natural Resources Canada, Treatment of Bitumen Froth and Slop Oil Tailings.
New Logic Research, Using V SEP to Treat Desalter Effluent, Case Study Copyright 2003, 9 pages.
Rimmer et al., Hydrocyclone-based Process for Rejecting Solids from Oil Sands at the Mine Site While Retaining Bitumen for Transportation to a Processing Plant, entitled Oil Sands-Our Pertroleum Future, Suncor Extraction 3rd fl, paper delivered on Monday at a conference, Apr. 5, 1993, Alberta, Canada.
Schramm et al. "Some Observatiions on the Aging Phenomenon in the Hot Water Processing of Athabasca Oil Sands. Part 1—The Nature of the Phenomenom", AOSTRA J. Res., 3 (1987) 195-214.
Schramm et al. "Some Observations on the Aging Phenomenom in the Hot Water Processing of Athabasca Oil Sands. Part 2—The Mechanism of Aging", AOSTRA J. Res., 3 (1987) 215-224.
Schramm et al. "Two Classes of Anionic Surfactants and Their Significance in Hot Water Processing of Oil Sands", Can. J. Chem. Eng., 65 (1987) 799-811.
Schramm et al., The influence of Natural Surfactant Concentration on the Hot Water Process for Recovering Bitumen from the Athabasca Oil Sands, AOSTRA Journal of Research, vol. 1, Issue 1984, pp. 5-13.
The Fine Tailings Fundamentals Consortium "Advances in Oil Sands Tailings Research" ISBN 0-7732-1691-X Published by Alberta Department of Energy Jun. 1995.
Wallace et al., A Physical Chemical Explanation for Deterioration in the Hot Water Processability of Athabasca Oil Sand Due to Aging, Fuel Sci. Technol. Int., 1989, vol. 7, pp. 699-725.

* cited by examiner

BITUMINOUS FROTH INLINE STEAM INJECTION PROCESSING

CROSS-REFERENCE TO RELATED APPLICATION

This application is a continuation of U.S. application Ser. No. 12/493,910, filed Jun. 29, 2009, and issued on Mar. 29, 2011 as U.S. Pat. No. 7,914,670 and which is a divisional application of U.S. application Ser. No. 10/825,230, filed Apr. 16, 2004 and issued Jul. 7, 2009. U.S. application Ser. No. 10/825,230, which is now U.S. Pat. No. 7,556,715, claims priority to and benefit of Canadian Patent Application Number 2455011, filed Jan. 9, 2004, the disclosure of which is incorporated herein by reference in its entirety.

BACKGROUND

1. Field

This invention relates to bitumen processing and more particularly is related to heating bituminous froth using inline steam injection.

2. Description of Related Art

In extracting bitumen hydrocarbons from tar sands, one extraction process separates bitumen from the sand ore in which it is found using an ore washing process generally referred to as the Clark hot water flotation method. In this process, a bitumen froth is typically recovered at about 150° F. and contains residual air from the flotation process. Consequently, the froth produced from the Clark hot water flotation method is usually described as aerated bitumen froth. Aerated bitumen froth at 150° F. is difficult to work with. It has similar properties to roofing tar. It is very viscous and does not readily accept heat. Traditionally, processing of aerated bitumen froth requires the froth to be heated to 190° F. to 200° F. and de-aerated before it can move to the next stage of the process.

Heretofore, the aerated bitumen froth is heated and de-aerated in large atmospheric tanks with the bitumen fed in near the top of the vessel and discharged onto a shed deck. The steam is injected below the shed deck and migrates upward, transferring heat and stripping air from the bitumen as they contact. The method works but much of the steam is wasted and bitumen droplets are often carried by the exiting steam and deposited on nearby vehicles, facilities and equipment.

SUMMARY

The invention provides an inline steam heater to supply heated steam to a bitumen froth by direct contact of the steam to the bitumen froth resulting in superior in efficiency and environmental friendliness than processes heretofore employed.

In one of its aspect, the invention provides an inline bitumen froth steam heater system including at least one steam injection stage, each steam injection stage followed by a mixing stage. Preferably, the mixing stage obtains a mixing action using static mixing devices, for example, using baffle partitions in a pipe. In operation, the invention heats the bitumen froth and facilitates froth deaeration by elevating the froth temperature. In operation the bitumen froth heating is preferably obtained without creating downstream problems such as emulsification or live steam entrainment. The froth heater is a multistage unit that injects and thoroughly mixes the steam with bitumen resulting in solution at homogenous temperature. Steam heated to 300 degrees Fahrenheit is injected directly into a bitumen froth flowing in a pipeline where initial contact takes place. The two incompatible substances are then forced through a series of static mixers, causing the steam to contact the froth. The mixer surface area and rotating action of the material flowing through the static mixer breaks the components up into smaller particles, increasing contact area and allowing the steam to condense and transfer its heat to the froth. The reduction in bitumen viscosity also allows the release of entrapped air.

Other objects, features and advantages of the present invention will be apparent from the accompanying drawings, and from the detailed description that follows below. As will be appreciated, the invention is capable of other and different embodiments, and its several details are capable of modifications in various respects, all without departing from the invention. Accordingly, the drawings and description of the preferred embodiments are illustrative in nature and not restrictive.

DETAILED DESCRIPTION OF THE INVENTION

In accordance with a preferred embodiment of the process two inputs components, namely, bitumen froth and steam, are contacted to produce an output homogenous bitumen product heated to a temperature of 190° F. The input bitumen froth component 10 is supplied at about 150° F. In a pilot plant implementation the input bitumen froth component is supplied via a 28 inch pipeline at a rate of about 10,000 barrels per hour. The input steam component 12 is supplied as a superheated steam at about 500° F. and at 150 psi.

Figure 1:
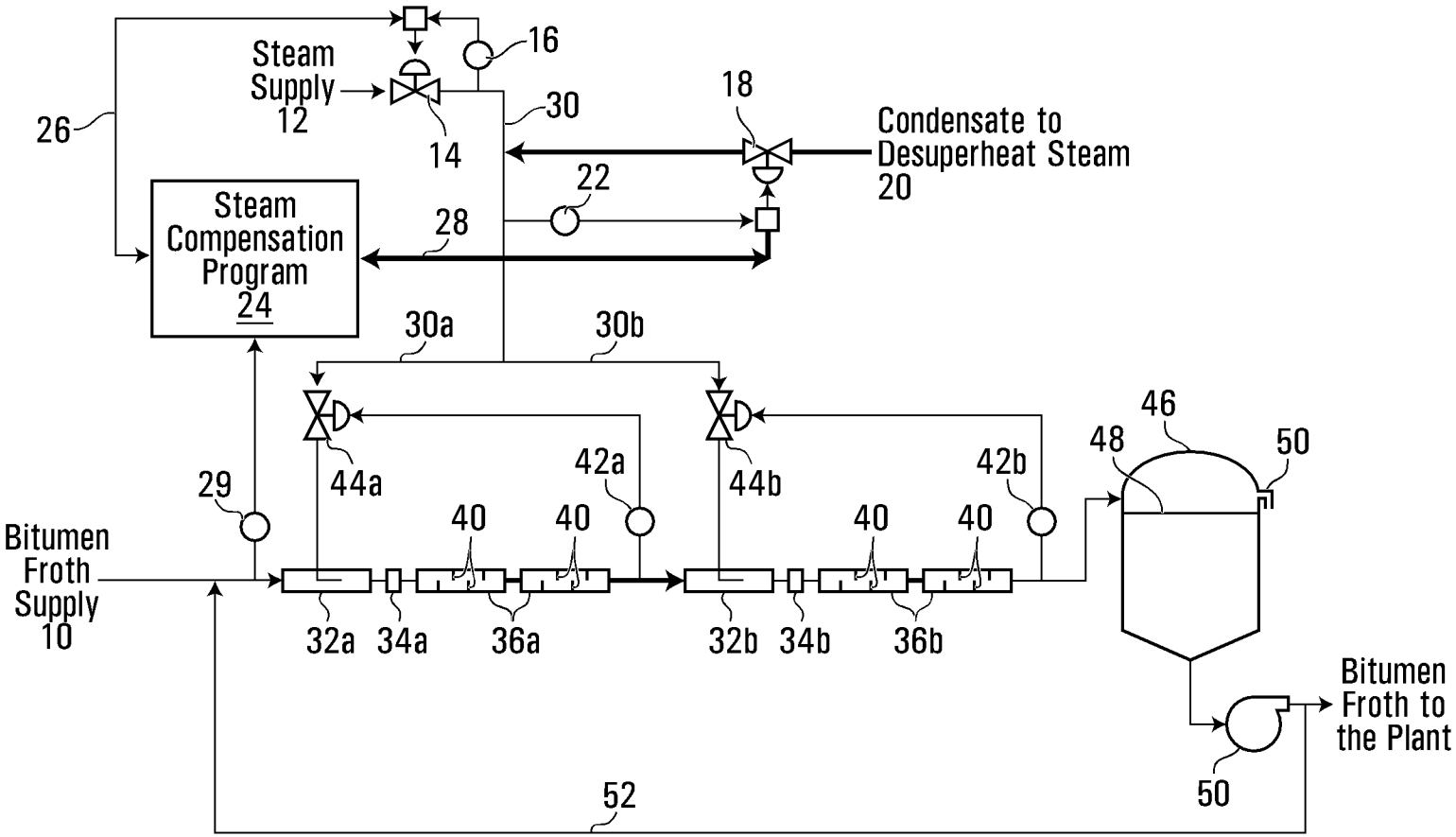
FIG. 1 is a functional block diagram of a preferred embodiment of a bitumen froth heating process arrangement of the invention.

FIG. 1 shows a functional block diagram of a preferred embodiment of a bitumen froth heating apparatus arranged in accordance with the invention. The input steam component 12 is supplied to a pressure control valve 14 which reduces the pressure to a set point pressure, which is typically about 90 psi. A pressure transmitter 16 is provided to monitor the pressure of the steam downstream from the pressure control valve 14 to provide a closed loop control mechanism to control the pressure of the steam at the set point pressure. The pressure controlled steam is supplied to a temperature control valve 18 that is used to control the supply of condensate 20 to cool the steam to its saturation point, which is about 300° F. at the controlled pressure of 90 psi. A temperature sensor 22 monitors the steam temperature downstream from the temperature control valve to provide a closed loop control mechanism to control the temperature of the steam at the temperature set point setting.

The optimum parameters for steam injection vary so a computer 24 executes a compensation program to review the instantaneously supplied instrumentation pressure 26 and temperature 28 measurements and adjusts inlet steam pressure and temperature set point settings as required. A pressure sensor 29 measures the pressure of the input bitumen component 10 to provide the compensation program executing on computer 24 with this parameter to facilitate optimum control of the parameters for steam injection.

To provide a greater capacity for supply or transfer of heat to the bitumen froth component, the pressure and temperature controlled steam 30 is split into two steam sub-streams 30*a*, 30*b*. Each steam sub-stream is supplied to a respective steam injector 32*a*, 32*b* and the steam injectors 32*a* and 32*b* are arranged in series to supply heat to the bitumen froth component stream 10. While two steam injectors arranged in series are shown in the figure, it will be understood that the bitumen froth component stream 10 could equally well be split into two sub-streams and each bitumen froth component sub-stream supplied to a respective steam injector arranged in parallel. Moreover, it will be understood that more than two sub-streams of either the steam component or the bitumen component streams could be provided if process flow rates require. A suitable inline steam injector 32*a*, 32*b* is manufactured by Komax Systems Inc. located in Calif., USA.

An inline steam injection heater works well in heating water compatible fluids but bitumen is not water compatible so additional mixing is advantageous to achieve uniform fluid temperature. Consequently, in the preferred embodiment depicted in FIG. 1, the bitumen and steam material flow mixture is passed through an inlet baffle 34*a*, 34*b* downstream from the respective steam injector 32*a*, 32*b*. The inlet baffle, which is shown more clearly in FIG. 2*a*, directs the material flow mixture downward to initiate the mixing action of the steam component with the bitumen froth component. Mixing of the material flow continues by passing the material flow through static mixers 36*a* and 36*b* respectively.

Figures 2, 2A:
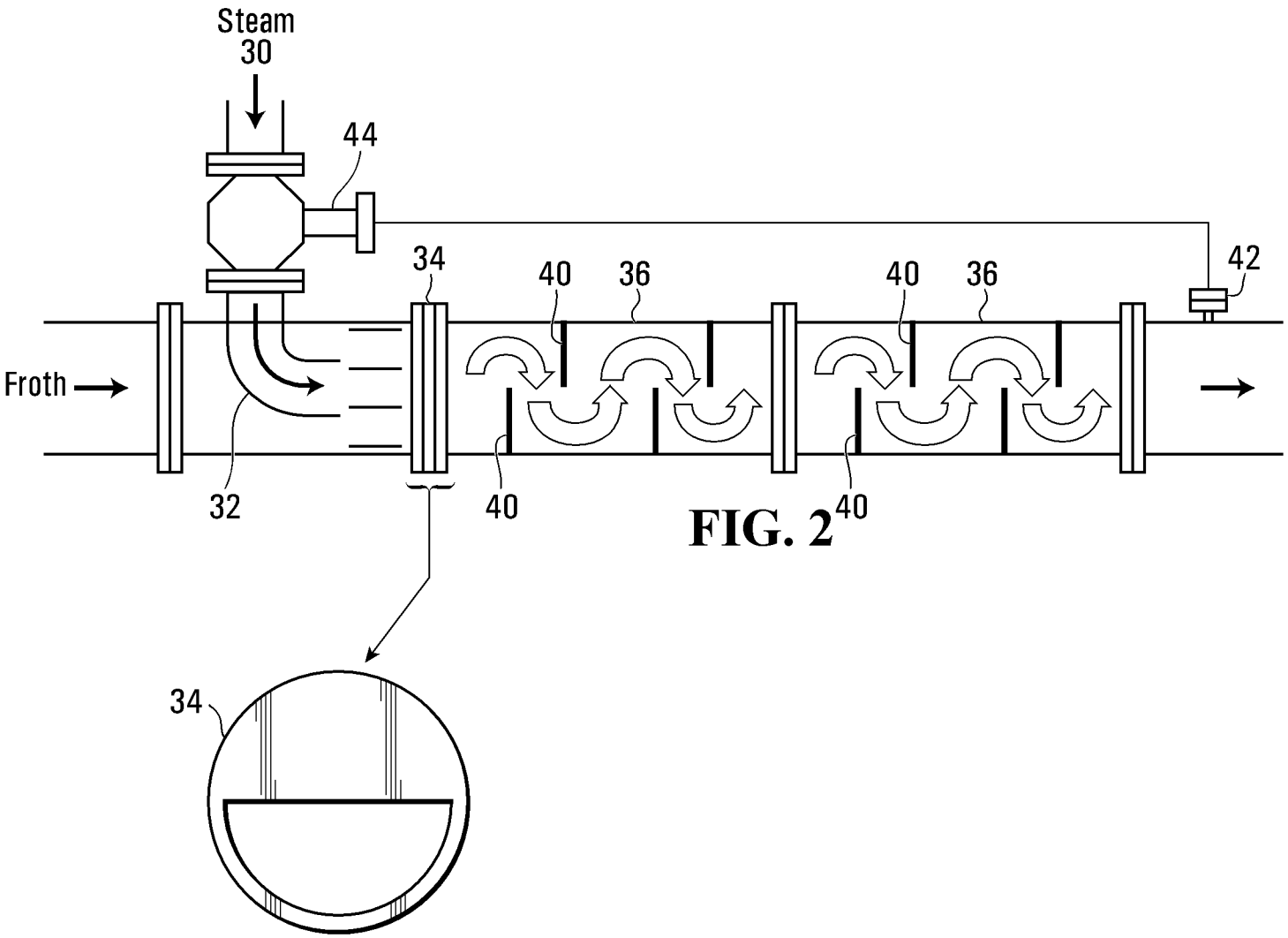
FIG. 2 is a cross section elevation view of an inline steam heater and mixer stage of FIG. 1.
FIG. 2*a* is an elevation view of a baffle plate of FIG. 2.

As seen most clearly in FIG. 2, the static mixers provide baffles 40 arranged along the interior volume of each static mixer to effect a mixing action of the material flowing through the static mixer. The mixing action of the material flow through the static mixer is provided by arranging the baffles 40 within the static mixer to impart a lateral, radial, tangential and/or circumferential directional component to the material flow that changes repeatedly along the length of the static mixer. Different static mixer designs and baffle arrangements may be used to advantage in mixing the steam component with the bitumen froth component.

A temperature transmitter 42 is located downstream of the mixers 36. The temperature of the material flow exiting the static mixer is measured by the temperature transmitter 42 and is used to control the rate of supply of steam to the inline steam injector 32 by the associated flow control valve 44. In this manner, a closed loop control system is provided to control the supply of the steam component to the bitumen froth component to obtain a set point or target output temperature of the material flow leaving the static mixer 36.

Referring again to FIG. 1, the heating system shown in FIG. 2 is arranged with a temperature transmitter 42*a*, 42*b* located downstream of each respective mixer 36*a*, 36*b*. The temperature of the material exiting each static mixer is measured by the temperature transmitter and is used to control the rate of supply of steam to the inline steam injectors 32*a*, 32*b* by the associated flow control valve 44*a*, 44*b* respectively. In this manner, a closed loop control system is provided to control the supply of the steam component to the bitumen froth component to obtain a set point or target output temperature of the material flow leaving each static mixer stage 36*a*, 36*b*. The water content of the bitumen froth component 10 can range form 30% to 50%. In a pilot plant implementation of the preferred embodiment, each inline steam heater 32*a*, 32*b* was found to be capable of heating about 10,000 barrels per hour of bitumen froth by about 30° F. utilizing about 80,000 pounds per hour of steam. By way of comparison to conventional process apparatus, the atmospheric tank method would use about 125,000 pounds of steam to achieve a similar heat transfer.

After heating, the heated bitumen froth is delivered to a plant for processing. To facilitate material flow rate co-ordination with the processing plant, the heated bitumen froth may be discharged to a downstream holding tank 46, preferably above the liquid level 48. The heated, mixed bitumen froth releases entrained air, preferably, therefore, the holding tank is provided with a vent 50 to disperse the entrapped air released from the bitumen froth. To maintain the temperature of the heated bitumen froth in the holding tank 46, a pump 50 and recycle line 52 are provided, which operate to recycle the hot bitumen froth from the holding tank to the process inlet of the heaters.

The invention has been described with reference to preferred embodiments. Those skilled in the art will perceive improvements, changes, and modifications. The scope of the invention including such improvements, changes and modifications is defined by the appended claims.

What is claimed is:

1. A system for heating a bitumen froth by steam, the system comprising:

i. means for providing a source of steam;

ii. means for contacting the steam with a bitumen froth flow within an enclosed passageway of an inline body;

iii. means for forcing the bitumen froth flow and the steam through the enclosed passageway so as to cause the steam to mix with the bitumen froth flow to form a heated feed having a generally uniform temperature; and iv. means for forcing all of the heated feed to exit through an outlet of the enclosed passageway.

2. The system of claim 1 further comprising means for controlling the rate of steam supply of the steam contacting the bitumen froth flow to control the generally uniform temperature of the heated feed.

3. The system of claim 2 further comprising:

i. means for measuring the generally uniform temperature of the heated feed; and ii. means for varying the rate of steam supply of the steam contacting the bitumen froth flow to obtain a target uniform temperature of the heated feed.

4. The system of claim 1 further comprising means for controlling the pressure of the steam supply of the steam contacting the bitumen froth flow.

5. The system of claim 4 further comprising:

i. means for measuring the controlled pressure of the steam supply; and ii. means for varying the rate of the steam supply to obtain a target pressure of the steam contacting the bitumen froth flow.

6. The system of claim 1 further comprising means for providing a condensate to the steam supply to control the temperature of the steam contacting the bitumen froth flow.

7. The system of claim 6 further comprising:

i. means for measuring the controlled temperature of the steam supply; and ii. means varying the rate of providing condensate to the steam supply to obtain a target temperature of the steam contacting the bitumen froth flow.

8. A system for heating a bitumen froth by steam, the system comprising:

i. means for providing a source of steam;

ii. means for controlling the pressure of the steam;

iii. means for controlling the temperature of the steam;

iv. means for controlling the rate of supply of the steam;

v. means for contacting the steam with a bitumen froth flow within an enclosed passageway of an inline heater body; and vi. means for forcing the bitumen froth flow and the steam through the enclosed passageway so as to cause the steam to mix with the bitumen froth flow to form a heated feed having a generally uniform temperature; and vii. means for forcing all of the heated feed to exit through an outlet of the enclosed passageway.

9. The system of claim 8, further comprising means for forcing all of the heated feed to exit through the outlet when the enclosed passageway is disposed generally parallel to the horizontal axis.

10. The system of claim 8 further comprising means for imparting a generally lateral, radial, tangential or circumferential directional component to the bitumen froth flow and the steam within the enclosed passageway, the directional component changing repeatedly along a length of the enclosed passageway.

11. The system of claim 8, wherein the steam contacting the bitumen froth flow has a temperature of about 300° F. to about 500° F. and a pressure of about 90 to 150 psi.

12. The system of claim 8, wherein the heated feed has a temperature of about 190° F.

13. The system of claim 8, wherein the steam contacting the steam with a bitumen froth flow consists of saturated steam.

14. A system for heating a bitumen froth using steam, the system comprising:

(a) means for introducing bitumen froth and the steam into a chamber of an injector body, the steam having a steam flow;

(b) means for causing the bitumen froth and the steam to pass from the chamber into an enclosed passageway of a static mixing body;

(c) means for forcing the bitumen froth and the steam through the enclosed passageway so as to cause the steam to mix with the bitumen froth and form a heated feed; and (d) means for forcing substantially all of the heated feed to exit through an outlet of the enclosed passageway.

15. The system of claim 14 further comprising means for forcing all of the heated feed to exit through the outlet when the enclosed passageway is disposed generally parallel to the horizontal axis.

16. The system of claim 14 further comprising means for imparting a generally lateral, radial, tangential or circumferential directional component to the bitumen froth and the steam within the enclosed passageway, the directional component changing repeatedly along a length of the enclosed passageway.

17. The system of claim 14 further comprising means for blocking a portion of a flow of the bitumen froth and the steam within the enclosed passageway using a plurality of static mixer barriers forming partial walls disposed within the enclosed passageway.

18. The system of claim 14, wherein the steam being introduced into the chamber has a temperature of about 300° F. to about 500° F. and a pressure of about 90 to 150 psi.

19. The system of claim 14, wherein the heated feed being produced by the static mixer body has a temperature of about 190° F.

20. The system of claim 14, wherein the steam being introduced into the chamber consists of saturated steam.

21. A system for heating a bitumen froth with steam to produce a heated bitumen froth product, the system comprising:

(a) bitumen froth receiving means for receiving a bitumen froth flow from a bitumen froth supply;

(b) steam receiving means for receiving steam from a steam supply;

(c) steam injection means for injecting steam received from the steam supply into the bitumen froth flow; and (d) mixing means for mixing the bitumen froth flow and the injected steam in an enclosed passageway until they form a heated feed having a generally uniform temperature; and (e) discharge means for discharging substantially all of the heated feed from the enclosed passageway as the heated bitumen froth product.

22. The system of claim 21 further comprising:

(f) holding means, in communication with the discharge means, for holding the heated bitumen froth product; and (g) recycling means for recycling at least some of the heated bitumen froth product held in the holding means to the bitumen froth receiving means.

23. The system of claim 21 wherein the steam injection means is operably configured to direct steam flow in substantially the same direction as the bitumen froth flow.

24. The system of claim 21 further comprising steam injection control means for controlling steam injection parameters in response to a bitumen froth supply pressure.

25. The system of claim 21 further comprising a processing plant, in communication with the discharge means, for processing the heated bitumen froth product.

26. The system of claim 21 wherein the heated feed is a generally homogenous mixture of bitumen froth from the bitumen froth flow and the injected steam in condensed form.

* * * * *